US006192708B1

(12) United States Patent
Mitchell

(10) Patent No.: US 6,192,708 B1
(45) Date of Patent: Feb. 27, 2001

(54) FINGER RING INSERT

(76) Inventor: James Valliant Mitchell, 4703 N. Meadow Ridge Cir., McKinney, TX (US) 75070

( * ) Notice: Subject to any disclaimer, the term of this patent is extended or adjusted under 35 U.S.C. 154(b) by 0 days.

(21) Appl. No.: 09/309,338

(22) Filed: May 11, 1999

(51) Int. Cl.[7] ..... A44C 9/02
(52) U.S. Cl. ..... 63/15.6; 63/15
(58) Field of Search ..... 63/15, 15.5, 15.6, 63/15.65

(56) References Cited

U.S. PATENT DOCUMENTS

| | | | | |
|---|---|---|---|---|
| Re. 24,798 | * | 3/1960 | Lund | 63/15.6 X |
| 216,492 | * | 6/1879 | Wells | 63/15.6 |
| D. 249,878 | | 10/1978 | Sokoloski . | |
| D. 264,827 | | 6/1982 | Cunningham . | |
| D. 337,543 | | 7/1993 | Caldow . | |
| D. 377,769 | | 2/1997 | Roemer . | |
| D. 393,227 | | 4/1998 | Roemer . | |
| 569,900 | * | 10/1896 | Wells | 63/15.6 |
| 1,106,814 | * | 8/1914 | Holzel | 63/15.6 |
| 1,115,764 | * | 11/1914 | Applas | 63/15.6 |
| 1,382,043 | * | 6/1921 | Young | 63/15.6 |
| 2,579,856 | * | 12/1951 | Pollard et al. | 63/15.6 |
| 3,237,426 | * | 3/1966 | Doering | 63/15.6 |
| 3,380,263 | * | 4/1968 | Astor | 63/15.6 |
| 3,460,356 | * | 8/1969 | Lodrini | 63/15.6 |
| 3,483,718 | | 12/1969 | Lodrini . | |
| 4,129,999 | | 12/1978 | Shelton . | |
| 4,245,485 | | 1/1981 | Bushong . | |
| 4,261,185 | | 4/1981 | Martinez . | |
| 4,377,079 | | 3/1983 | Krueger . | |
| 4,471,634 | | 9/1984 | Kaplan . | |
| 4,480,447 | | 11/1984 | Lodrini . | |
| 4,569,211 | | 2/1986 | Lodrini . | |
| 4,903,507 | | 2/1990 | Gesensway . | |
| 4,916,924 | | 4/1990 | Borgenicht . | |
| 5,261,256 | | 11/1993 | Ellenbecker et al. . | |
| 5,636,531 | | 6/1997 | Miller . | |
| 5,669,241 | | 9/1997 | Kohl . | |

FOREIGN PATENT DOCUMENTS

| | | | | |
|---|---|---|---|---|
| 415925 | * | 10/1910 | (FR) | 63/15.6 |
| 1434513 | * | 5/1976 | (GB) | 63/15.6 |

* cited by examiner

*Primary Examiner*—Terry Lee Melius
*Assistant Examiner*—Andrea Chop

(57) ABSTRACT

A finger ring insert for use with a finger ring. The finger insert comprises a saddle shaped top portion, side portions, and rounded end portions that are seamlessly coupled to the saddle shaped top portion and the side portions. The finger ring insert includes a opening that extends from one side of the insert to the other side of the insert and allows the insert to be snappingly attached to and detached from the ring.

16 Claims, 6 Drawing Sheets

FINGER RING INSERT

BACKGROUND OF THE INVENTION

The present invention relates generally to finger ring inserts and, more particularly, to a finger ring insert that can be snappingly attached to and detached from a circular lower band portion of a ring to allow a tighter fit of the ring on a wearer's finger. Additionally, the finger ring insert secures the ring from movement along the wearer's finger.

Situations may arise when a ring may not accurately fit a wearer's finger. To compensate for such a problem, the ring may be cut and resized to better fit the wearer's finger. While this solution may work, it also means the ring band must be cut and then resized to the proper finger ring size. Additionally, if the ring does not fit the wearer's finger at a later time or if the ring was incorrectly resized, the ring band must be cut again and enlarged (by soldering, to the ring band, additional material that is similar to the ring band) to properly fit the wearer's finger. To overcome the problems associated with cutting a ring band to resize a ring, a ring insert (or ring sizer or ring guard) may be placed on the ring band to reduce the size of the ring.

Such ring inserts have been described in the prior art. For example, U.S. Pat. Nos. 3,483,718 and 4,480,447 describe a finger ring insert that utilizes a leaf spring that is disposed under the top wall of the insert and that slidingly engages the lower band portion of the ring. Further, the ring insert includes bendable tabs that are bent along the outer edges and bottom of the ring band to secure the insert to the ring band. A problem with such a ring insert is that the ring insert includes a leaf spring portion which increases the complexity and cost of producing the insert. Also, the leaf spring portion may break or be bent out of shape leaving the insert unusable. Additionally, the bendable tabs may easily snag or rip a wearer's clothes or other items due to the fact that they are bent along the outer edge of the ring band and are positioned in an open and unprotected manner. Further, if the insert is taken off and placed back on a number of times (on one or many rings), the bendable tabs may become weak and unable to hold the insert in place and may eventually break.

Another example of a finger ring insert, U.S. Pat. No. 4,569,211, describes a ring insert that does not utilize a leaf spring but uses bendable "ear portions" (tabs) that are bend along the outer edges of the ring band to secure the insert to the ring band. The potential of snagging or ripping clothing is still possible, however, because the "ear portions" are positioned in an open and unprotected manner. Further, if the insert is taken off and placed back on a number of times (on one or many rings), the ear portions may become weak and unable to hold the insert in place and may eventually break.

Additionally, U.S. Pat. Nos. 3,483,718, 4,480,447, and 4,569,211 do not provide a finger ring insert that keeps a ring from moving from side to side (North to South or East to West) along a wearer's finger.

SUMMARY

The present invention, therefore, provides a finger ring insert that snappingly attaches to and detaches from a top edge and side edges of a circular lower band portion of a ring. The finger ring insert comprises a saddle shaped top portion, side portions, and rounded end portions seamlessly coupled to the saddle shaped top portion and the side portions, wherein the saddle shaped top portion, the side portions, and the rounded end portions snuggly fit the top edge and the side edges of the lower band portion of the ring. The rounded end portions secure the ring from movement along a wearer's finger.

The side portions of the insert further comprise a plurality of outwardly projecting portions that snappingly attach the finger ring insert to the lower band portion of the ring. The outwardly projecting portions are received by the side edges of the lower band portion and secure the finger ring insert from movement along the lower band portion.

A major advantage is achieved with the finger ring insert of the present invention since the insert is a single piece that does not utilize a spring or any other additional component. Thus the insert is cheaper and easier to manufacture and has less potential to break because no additional components are used. Further, the finger ring insert of the present invention snuggly fits the top edge and the side edges of the lower band portion without the use of bendable tabs or ear portions. This will ensure that no part of the finger ring insert will potentially break or become so weak to render the insert useless.

Thus, the insert may be used on many different rings without the possibility of breaking or weakening the insert. Additionally, because the finger ring insert snuggly fits the top edge and the side edges of the lower band portion without the use of bendable tabs or ear portions, the insert will not snag on a wearer's clothes or other items. Also, the rounded end portions are adapted to secure the ring from movement along a wearer's finger thereby positioning the top of the ring in a central and aesthetically pleasing manner along the wearer's finger.

Description of a Preferred Embodiment

Figure 1:
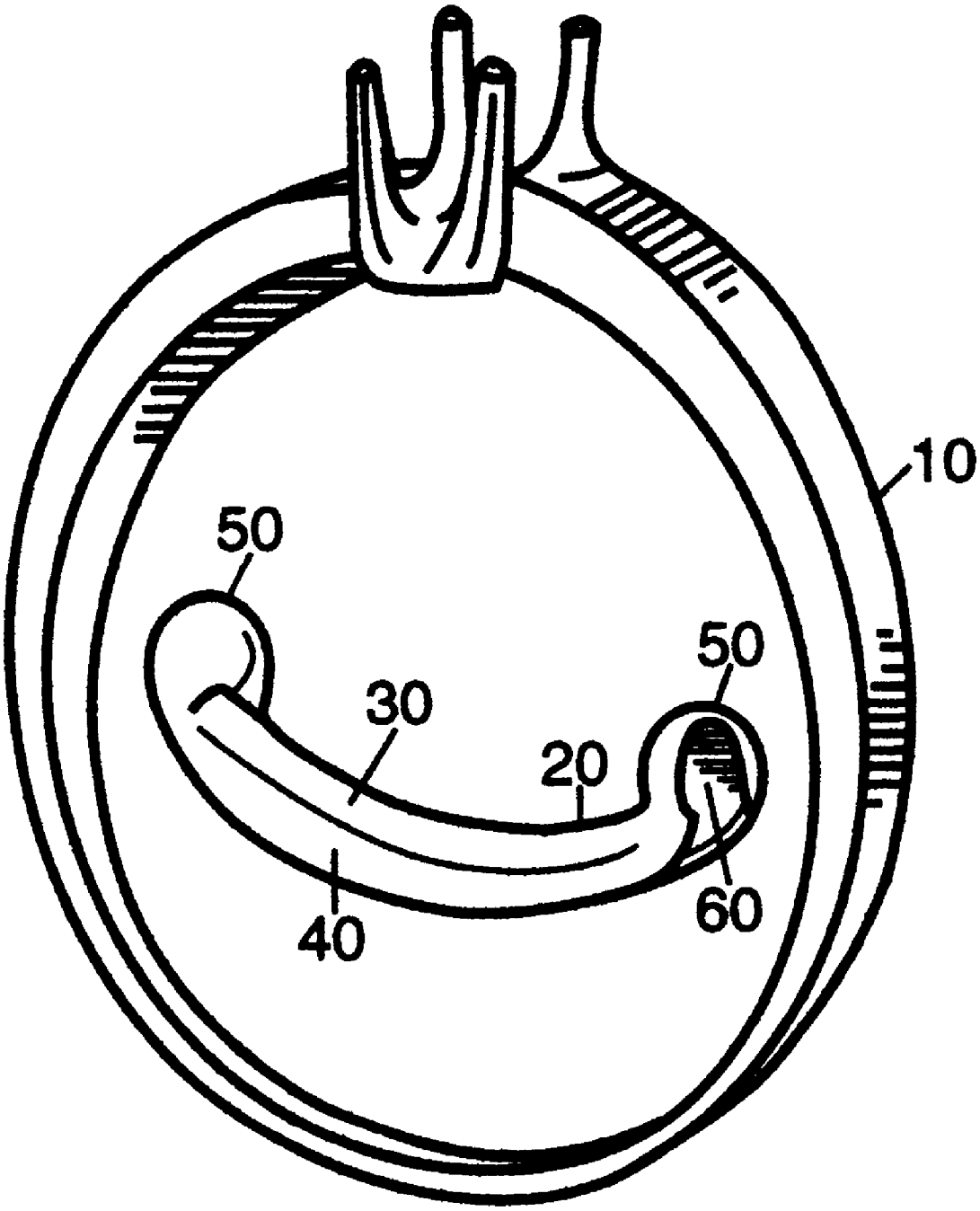
FIG. 1 is a perspective view of a finger ring and a finger ring insert of the present invention.

FIG. 1 depicts a finger ring 10 whose band portion contains no indentations or protrusions and a finger ring insert 20 for use with the finger ring. The finger insert 20 comprises a saddle shaped top portion 30, side portions 40 (for simplicity, only one side portion is shown) and rounded end portions 50 that are seamlessly coupled to the saddle shaped top portion and the side portions. The finger ring insert 20 includes an opening 60 that extends from one side of the insert to the other side of the insert and allows the insert to be snappingly attached to and detached from the ring 10.

Figure 2:
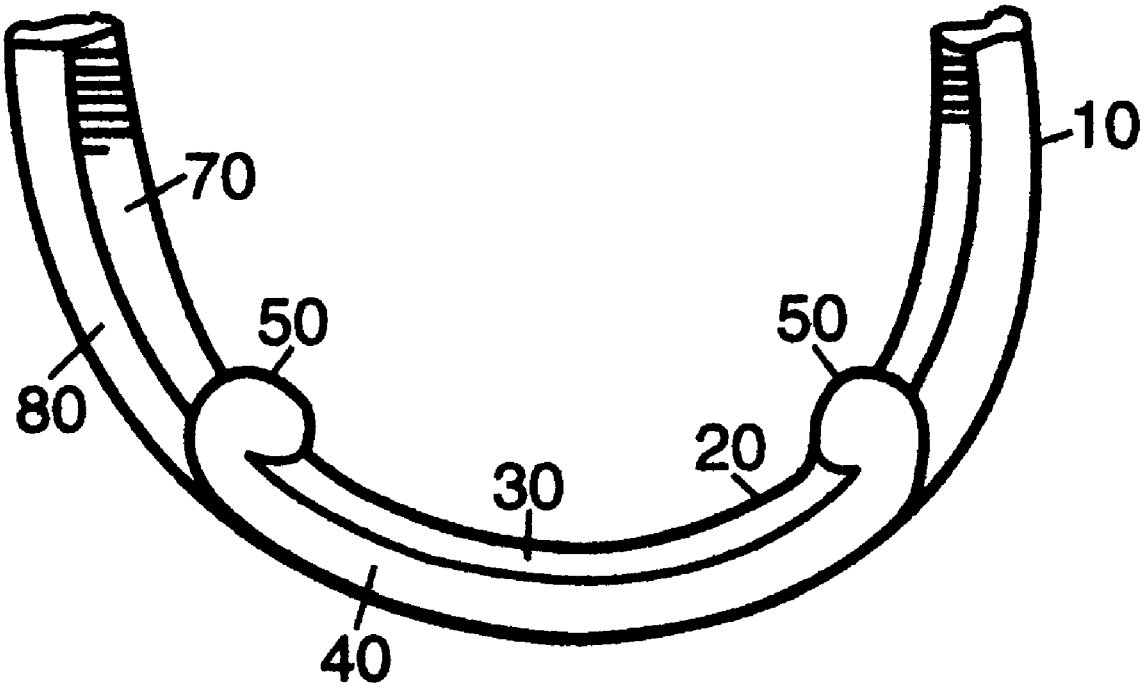
FIG. 2 is a perspective view of the finger ring insert of the present invention attached to the top edge and side edges of a circular lower band portion of the finger ring.
Figure 3:
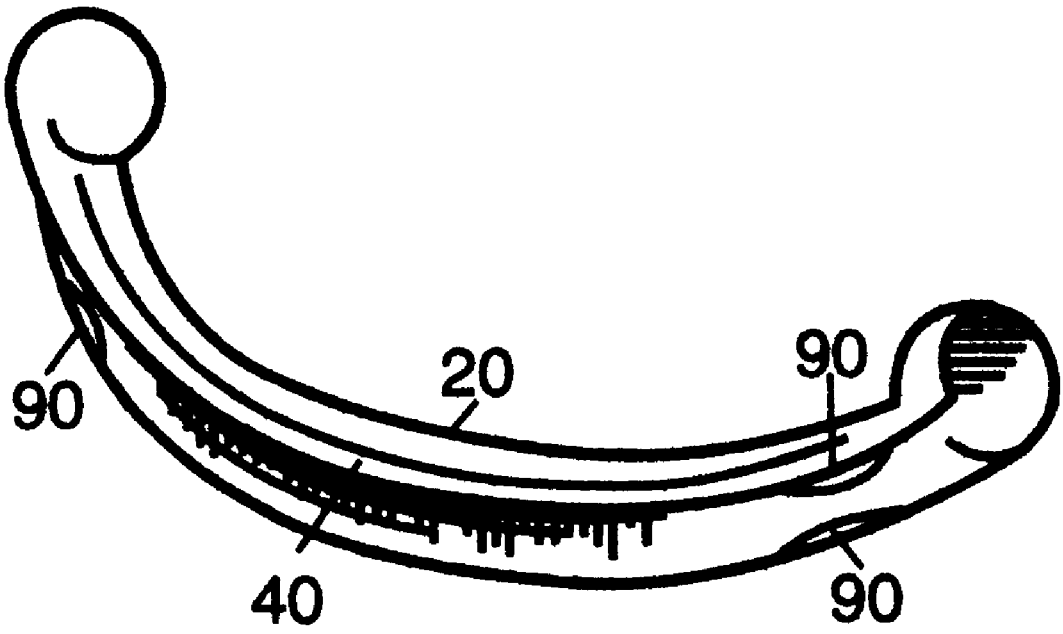
FIG. 3 is a perspective view of the outwardly projecting portions on the side portions of the finger ring insert of the present invention.

FIG. 2 depicts the finger ring insert 20 wherein the top portion 30, the side portions 40, and the rounded end portions 50 snuggly fit the top edge 70 and the side edges 80 (for simplicity, only one side edge is shown) of a circular lower band portion of the ring 10. The band portion of the ring 10 contains no indentations or protrusions. To place the finger ring insert 20 on the lower band portion, the insert is snapped into the side edges 80 of the lower band portions 40 via a plurality of outwardly projecting portions 90 that are seamlessly coupled to an interior of the side portions 40 as shown in FIG. 3. Although three outwardly projecting portions 90 are shown, a fourth outwardly projecting portion is included (but not shown) on one of the side portions 40. These outwardly projecting portions 90 secure the finger ring insert 20 from movement along the top edge 70 and the side edges 80 of the lower band portion. If the finger ring insert 20 is to be removed from the ring 10, it is simply detached (or snapped out of) the top edge 70 and the side edges 80 of the lower band portion.

The rounded end portions 50 are adapted to secure the ring from movement along the wearer's finger. When the wearer's finger is placed in the ring, the rounded end portions 50 "grip" the bottom of the wearer's finger thereby securing the ring in a specific location on the finger. This allows the ring to be centrally positioned on a wearer's finger and if a ring is top heavy, for example, the ring would not slide to a side (or from one side to another) of the wearer's finger. The ring would then be secured in an aesthetically pleasing location on the wearer's finger.

Figure 4:
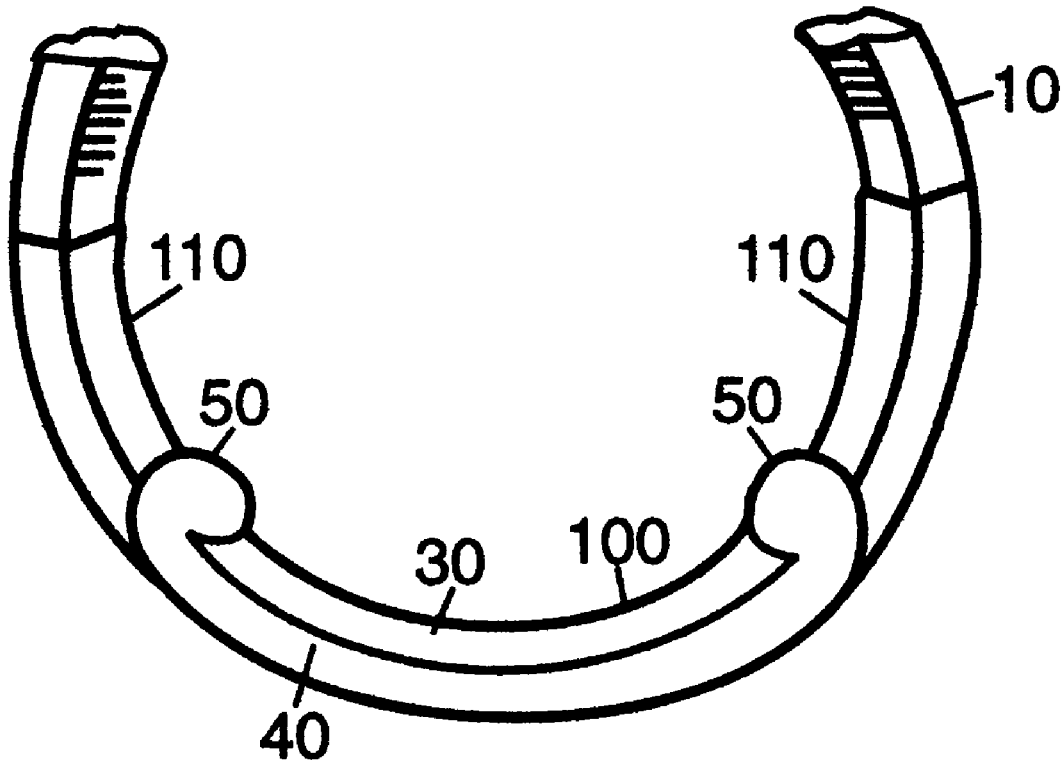
FIG. 4 is a perspective view of a finger ring insert of the present invention that includes a saddle shaped top portion and side portions that extend circularly and outwardly from rounded end portions.

FIG. 4 describes another embodiment of a finger ring insert of the present invention. Finger ring insert 100 includes a saddle shaped top portion 30 and side portions 40 that extend circularly and outwardly from the rounded end portions and snuggly fit around the lower and side band portions of ring 10. The saddle shaped top portion 30 and side portions 40 that extend circularly and outwardly from the rounded end portions are denoted by reference numeral 110. Such a finger ring insert would extend around most of the inner circumference of the ring band providing additional thickness to the band. The rounded portions 50 would still be adapted to secure the ring from movement along a finger but, with the additional thickness supplied by the portions 110, the ring insert would further secure the ring from movement along the sides of a wearer's finger. The finger ring insert 110 would be snappingly attached and detached from the ring band via the plurality of outwardly projecting portions 90 described in FIG. 3. Additional outwardly projecting portions 90 may be placed on the ring insert to further secure the insert from movement along the ring band.

Figure 5:
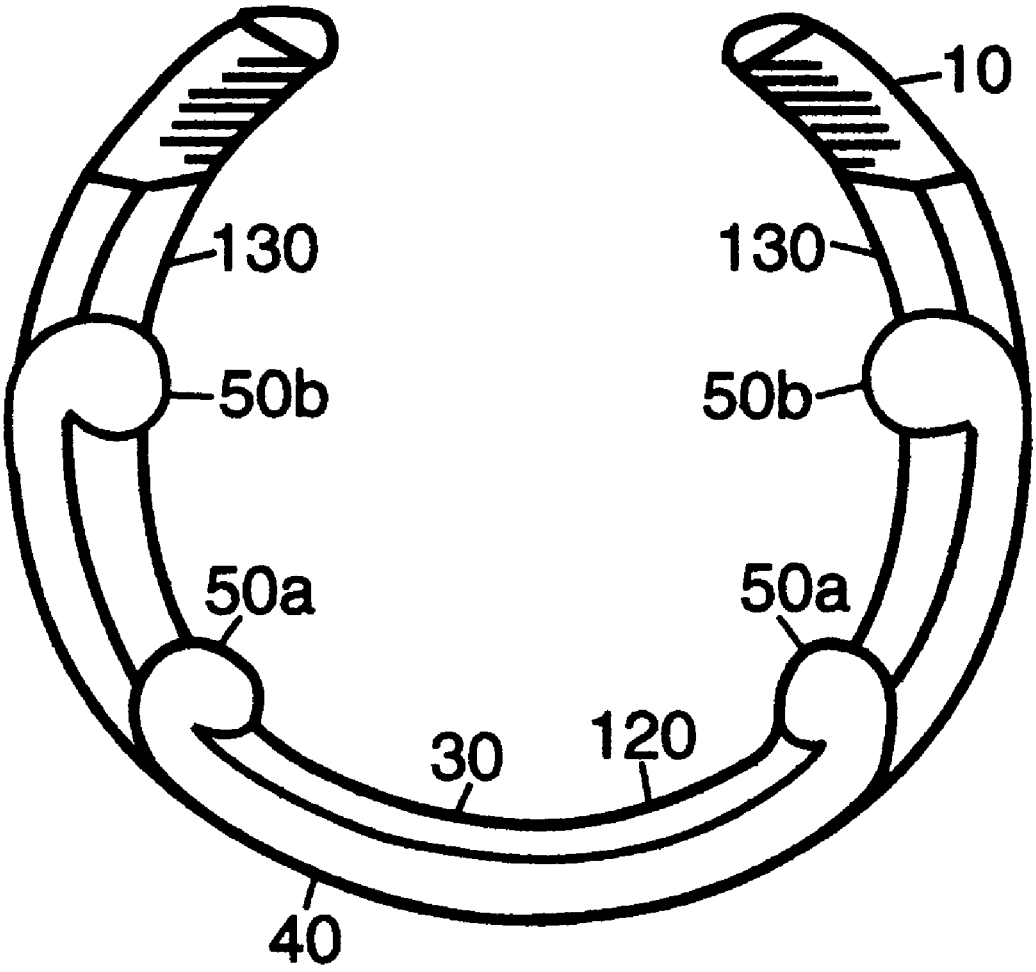
FIG. 5 is a perspective view of a finger ring insert of the present invention that includes a saddle shaped top portion and side portions that extend circularly and outwardly from two sets of rounded end portions.

FIG. 5 describes another embodiment of a finger ring insert of the present invention. Finger ring insert 120 includes a saddle shaped top portion 30 and side portions 40 that extend circularly and outwardly from the rounded end portions and snuggly fit around the lower and side band portions of ring 10. The saddle shaped top portion 30 and side portions 40 that extend circularly and outwardly from the rounded end portions are denoted by reference numeral 130. Such a finger ring insert would extend around most of the inner circumference of the ring band providing additional thickness to the band. A first set of rounded portions 50*a* would still secure the ring from movement along a finger but, with the additional thickness supplied by the portions 130 and with the second set of rounded portions 50*b*, the ring insert would further be adapted to secure the ring from movement along the sides of a wearer's finger. Finger ring insert 110 would be snappingly attached and detached from the ring band via the plurality of outwardly projecting portions 90 described in FIG. 3. Additional outwardly projecting portions 90 may be placed on the ring insert to further secure the insert from movement along the ring band.

Figure 6:
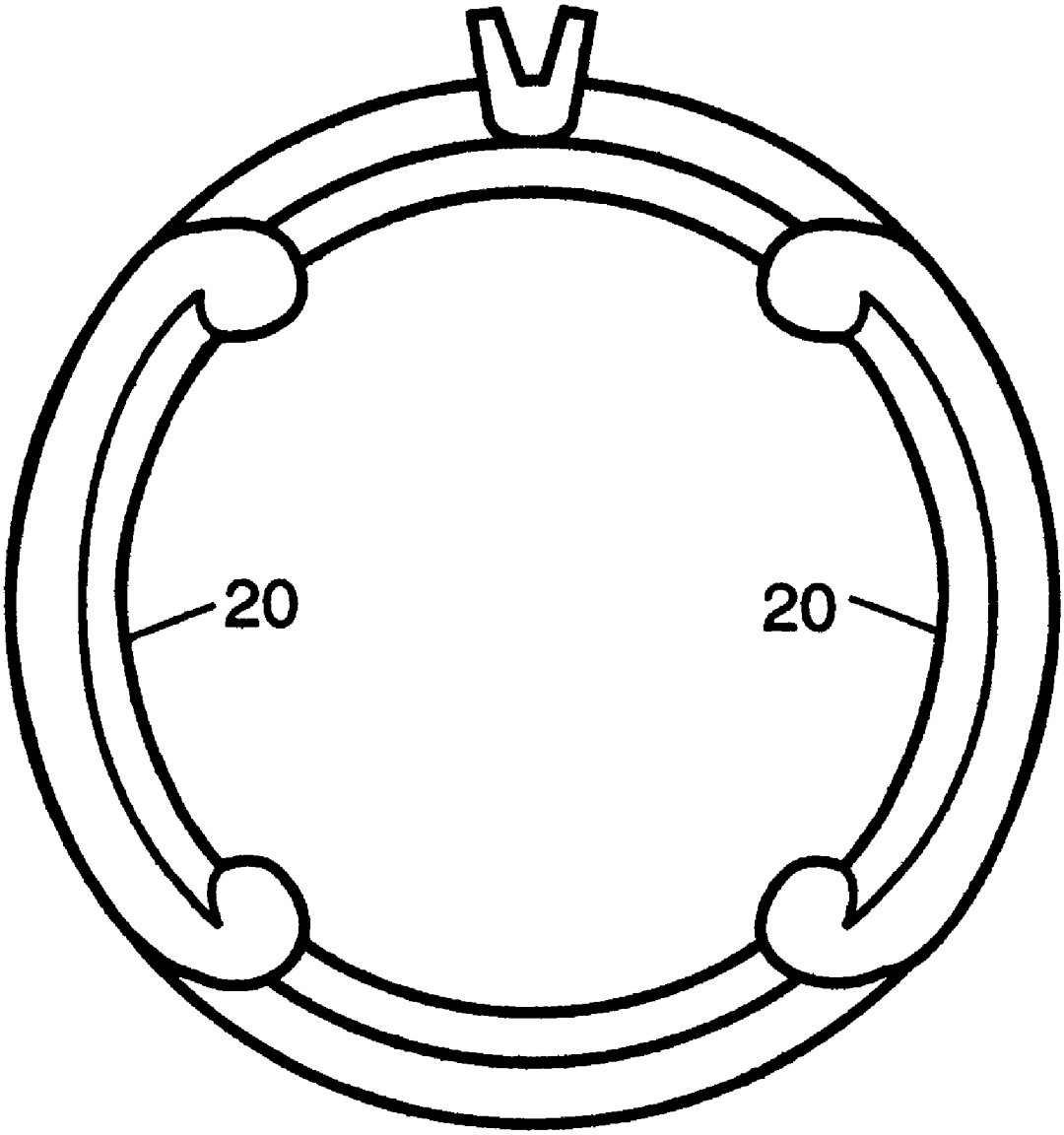
FIG. 6 is a perspective view of an alternate embodiment for placing, on a ring band, a plurality of finger ring inserts described in FIG'S. 1–3.

FIG. 6 describes a further embodiment of placing the finger ring insert, described in FIG'S. 1–3, on a ring band. In such an embodiment, ring insert 20 is placed on opposing sides of the ring band and adapted to snuggly fit the top edge and the side edges of the side band portions. The finger ring inserts 20 would extend around the side portions of the ring band providing additional thickness to the band. The ring inserts 20 could be positioned so that the rounded portions 50 would be adapted to secure the ring from movement along a wearer's finger in a customized manner. For example, one ring insert may be positioned higher along the band than the other ring insert. Finger ring inserts 20 would be snappingly attached and detached from the ring band via the plurality of outwardly projecting portions 90 described in FIG. 3.

It is understood that variations may be made in the foregoing without departing from the scope of the present invention. For example, the finger ring insert may be able to fit around the entire band portion of the ring band further securing a wearer's finger to the ring. Additionally, each of the plurality of outwardly projecting portions may be of varying thickness, depth, and width to ensure the ring insert is properly secured to the ring band and further secures the ring from movement along the ring band. Further, the plurality of outwardly projecting portions may be located in a plurality of positions on the ring insert. Still further, the finger ring insert may come in a plurality of shapes and sizes with varying thickness, depth, width, color, and substance (e.g. gold, silver, platinum, etc.).

It is understood that modifications, changes and substitutions are intended in the foregoing disclosure and in some instances some features of the disclosure will be employed without corresponding use of other features. Accordingly, it is appropriate that the appended claims be construed broadly and in a manner consistent with the scope of the disclosure.

What is claimed is:

1. In combination, a finger ring and a finger ring insert that snappingly attaches to and detaches from a top edge and side edges of a circular lower band portion of the finger ring, wherein the band portion has a smooth, uninterrupted surface, the finger ring insert comprises:

a saddle shaped top portion;

a pair of side portions each having an internal surface and an external surface, the internal surfaces facing one another, each of said side portions including a plurality of projections that snappingly attach the finger ring insert to the circular lower band portion of the finger ring, wherein the projections are seamlessly coupled to the internal surfaces of the side portions; and rounded end portions located at opposite free ends of the saddle shaped top portion and side portions, and seamlessly coupled between the saddle shaped top portion and the side portions, wherein the saddle shaped top portion and the side portions snuggly fit the top edge and the side edges of the lower band portion of the ring, respectively, and the rounded end portions snuggly fit both the top edge and the side edges of the lower band portion of the ring.

2. The combination of claim 1, wherein the projections are received by the side edges of the lower band portion of the finger ring.

3. The combination of claim 1, wherein the projections secure the finger ring insert from movement along the lower band portion.

4. The combination of claim 1, wherein the rounded end portions are adapted to secure the ring from movement along a wearer's finger.

5. In combination, a finger ring and a finger ring insert that snappingly attaches to and detaches from lower and side band portions of the finger ring, wherein the band portions has a smooth, uninterrupted surface, the finger ring insert comprises:

a saddle shaped top portion;

a pair of side portions each having an internal surface and an external surface, the internal surfaces facing one another, each of said side portions including a plurality of projections that snappingly attach the finger ring insert to the lower and side band portions of the ring, wherein the projections are seamlessly coupled to the internal surfaces of the side portions; and rounded end portions seamlessly coupled between the saddle shaped top portion and the side portions, wherein the saddle shaped top portion and side portions extend circularly and outwardly from the rounded end portions and wherein the saddle shaped top portion and the side portions snuggly fit the lower and side band portions of the ring, respectively, and the rounded end portions snuggly fit both the lower and side band portions of the ring.

6. The combination of claim 5, wherein the projections are received by the lower and side band portions of the ring.

7. The combination of claim 5, wherein the projections secure the finger ring insert from movement along the lower and side band portions of the ring.

8. The combination of claim 5, wherein the rounded end portions are adapted to secure the ring from movement along a wearer's finger.

9. In combination, a finger ring and a finger ring insert that snappingly attaches to and detaches from lower and side band portions of the finger ring, wherein the band portions has a smooth, uninterrupted surface, the finger ring insert comprises:

a saddle shaped top portion;

a pair of side portions each having an internal surface and an external surface, the internal surfaces facing one another, each of said side portions including a plurality of projections that snappingly attach the finger ring insert to the lower and side band portions of the ring, wherein the projections are seamlessly coupled to the internal surfaces of the side portions;

a first set of rounded end portions seamlessly coupled between the saddle shaped top portion and the side portions, wherein the saddle shaped top portion and side portions extend circularly and outwardly from the first set of rounded end portions; and a second set of rounded end portions seamlessly coupled between the circularly and outwardly extended saddle shaped top portion and side portions wherein the saddle shaped top portion and the side portions snuggly fit the lower and side band portions of the ring, respectively, and the first and second sets of rounded end portions snuggly fit both the lower and side band portions of the ring.

10. The combination of claim 9, wherein the projections are received by the lower and side band portions of the ring.

11. The combination of claim 9, wherein the projections secure the finger ring insert from movement along the lower and side band portions of the ring.

12. The combination of claim 9, wherein the first and second sets of rounded end portions are adapted to secure the ring from movement along a wearer's finger.

13. In combination, a finger ring and a finger ring insert that snappingly attaches to and detaches from a band portion of the finger ring, wherein the band portion has a smooth, uninterrupted surface, the finger ring insert comprises:

a saddle shaped top portion;

a pair of side portions each having an internal surface and an external surface, the internal surfaces facing one another, each of said side portions extending along the entire saddle shaped top portion and each of said side portions including a plurality of projections that snappingly attach the finger ring insert to the band portion of ring, wherein the projections are seamlessly coupled to the internal surfaces of the side portions; and rounded end portions located at opposite free ends of the saddle shaped top portion and side portions, and seamlessly coupled between the saddle shaped top portion and the side portions, wherein the saddle shaped top portion and the side portions snuggly fit the band portion of the ring.

14. The combination of claim 13, wherein the projections are received by the band portion of the ring.

15. The combination of claim 13, wherein the projections secure the finger ring insert from movement along the band portion.

16. The combination of claim 13, wherein the rounded end portions are adapted to secure the ring from movement along a wearer's finger.

* * * * *